US005551241A

United States Patent [19]

Boeckel et al.

[11] Patent Number: 5,551,241

[45] Date of Patent: Sep. 3, 1996

[54] THERMOELECTRIC COOLING CENTRIFUGE

[76] Inventors: John W. Boeckel, 1232 Georgia Hill Rd., Southbury, Conn. 06488-0358; Michael J. Parisi, 5207 Main St., Trumbull, Conn. 06611

[21] Appl. No.: 476,870

[22] Filed: Jun. 7, 1995

Related U.S. Application Data

[63] Continuation-in-part of Ser. No. 204,561, Mar. 2, 1994, Pat. No. 5,433,080.

[51] Int. Cl.[6] ..... F25B 21/02

[52] U.S. Cl. ..... 62/3.6; 62/3.2; 62/428; 494/14

[58] Field of Search ..... 62/3.2, 3.3, 3.6, 62/3.64, 3.62, 428; 494/13, 14

[56] References Cited

U.S. PATENT DOCUMENTS 4,512,758 4/1985 Wedemeyer et al. ..... 494/13
5,490,830 2/1996 Lovelady et al. ..... 494/14

*Primary Examiner*—John M. Sollecito
*Attorney, Agent, or Firm*—Eric P. Schellin

[57] ABSTRACT

A thermoelectric cooling design of the type having thermoelectric coolers. Provisions for a centrifuge chamber and improved heat dissipation from the thermoelectric coolers are provided. For improved thermal response, the refrigerated centrifuge chamber is provided with a motor driven fan to drive ambient air horizontally over a plurality of heat sinks mounted horizontally concentric with respect to the rotor of the centrifuge.

4 Claims, 1 Drawing Sheet

THERMOELECTRIC COOLING CENTRIFUGE

CROSS REFERENCE TO PRIOR APPLICATION

The present patent application is a continuation-in-part of U.S. patent application Ser. No. 08/204,561 filed on Mar. 2, 1994, now U.S. Pat. No. 5,433,080, in the name of the same inventor as herein, entitled: THERMOELECTRIC COOLING CENTRIFUGE. The said prior application is incorporated herein in its entirety by reference.

BACKGROUND OF THE INVENTION

This invention relates to thermoelectric coolers preferably designed for installation with in the housing of centrifuges. More particularly, the thermoelectric cooler is of the type having a heat sink over which ambient air is driven for the more efficient discharge of energy.

SUMMARY OF THE PRIOR ART

Wedemeyer et al U.S. Pat. No. 4,512,758 discloses the advantage of a nonconducting substrate including a plurality of thermoelectric modules of the Peltier effect type. The substrate with attached thermoelectric modules is clamped to the bottom of a centrifuging chamber on one side. By firmly impressing the chamber onto the heat sinks, efficient thermal conductivity and hence removal of heat from the chamber readily occurs. The device of Wedemeyer et al is slow in moving the heat content across the chamber thereby imposes an appreciable delay in cooling centrifuge rotors to desired centrifuging temperatures.

In a more recent U.S. Pat. No. 4,785,637 to Giebeler, a thermoelectric temperature control assembly is disclosed wherein heat is transferred to or from a heat sink. The heat sink is located below the chamber containing the centrifuge rotor.

Most critically, the efficiency of the thermoelectric cooled is dependent upon the heat discharge from the thermoelectric cooler. Such heat discharge includes heat extracted from the chamber as well as heat produced in the thermoelectric cooler by the Peltier effect. Ordinary heat sinks have been found other than optimum for this required heat discharge effect. As a result, cooling has been undesirably slow.

SUMMARY OF THE INVENTION

A thermoelectric cooling design of the type having thermoelectric coolers. Provisions for a centrifuge chamber and improved heat dissipation from the thermoelectric coolers are provided. For improved thermal response, the refrigerated centrifuge chamber is provided with a motor driven fan to drive ambient air horizontally over a plurality of heat sinks mounted horizontally concentric with respect to the rotor of the centrifuge.

In other words, a heat discharge heat sink is communicated to each thermoelectric cooler module for dissipating heat energy from both the chamber and the thermoelectric cooler.

Before centrifugation occurs with many samples, temperature thereof must be precisely controlled. In practice, classification of the sample in a rotor must occur at controlled temperature. An example of such a temperature is 2° centigrade for certain biological samples. The sample must be brought to the temperature and during centrifugation the sample must be maintained at that temperature. In both events cooling of the chamber is required. Due to their small size and weight, thermoelectric devices using the Peltier effect are ideally utilized.

The chamber is typically produced from relatively pure nonalloyed aluminum of the thinnest size possible to thereby obtain heat conduction through the shortest path possible. A thin wall thickness has the advantage of improving thermal response times. Both the heat capacity of the chamber and the thermal gradient produced by the chamber in cooling the rotor are reduced.

Thermoelectric modules require high thermal conductivity between chamber heat sinks and discharge heat sinks. At the interface between a thermoelectric module and discharge heat sink, a critical high flow heat discharge junction is defined.

BRIEF DESCRIPTION OF THE DRAWINGS

Other objects, features, and advantages will become more apparent after referring to the following specification and attached drawing in which.

DETAILED DESCRIPTION OF THE INVENTION

Figure 1:
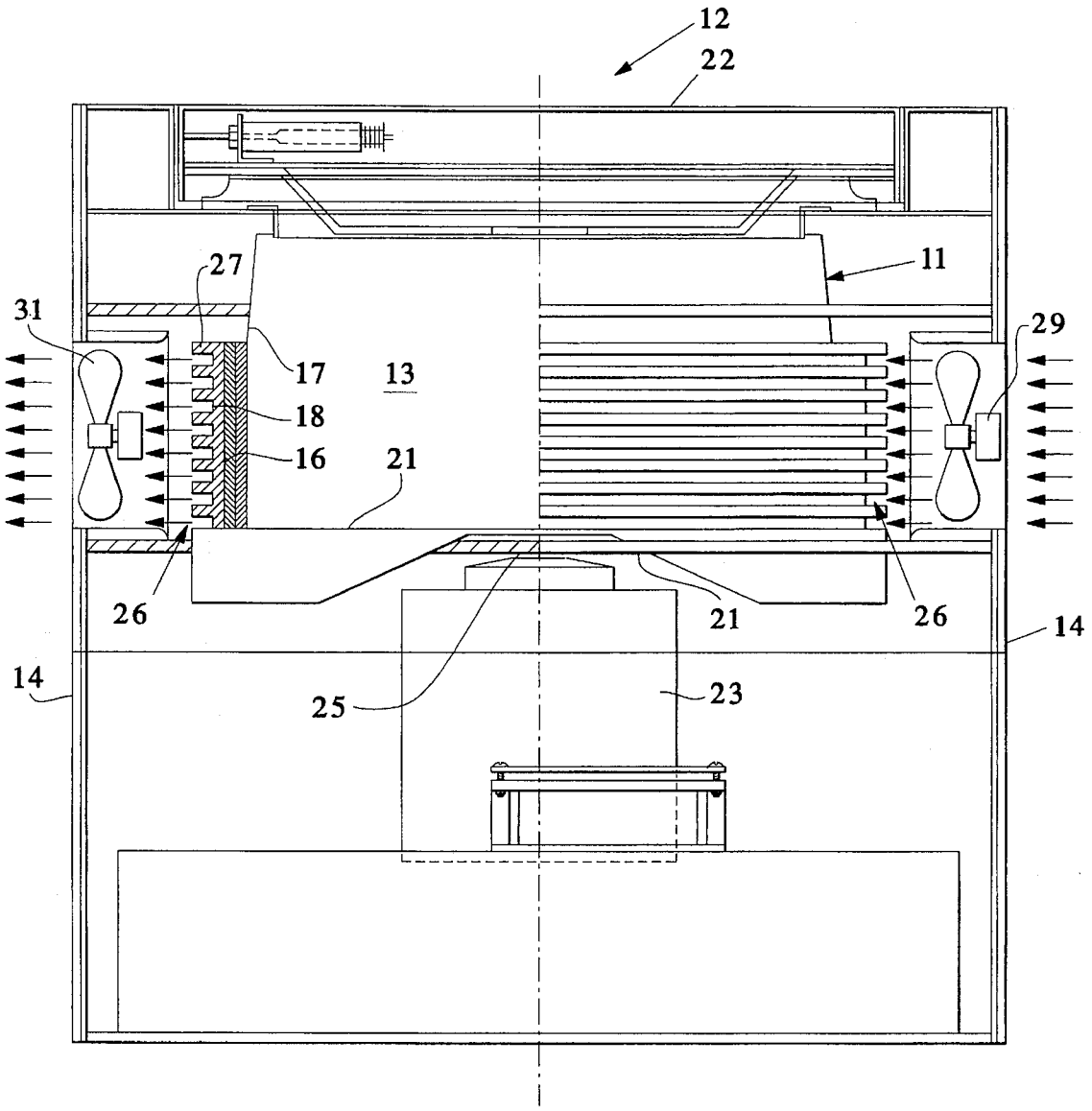
FIG. 1 is a partial side cross sectional view of the centrifuge chamber assembly of the present invention.

Attention is now directed to the drawing which depicts a centrifuge 11, generally, shaped cylindrically and a generally shaped square housing 12 which surrounds said centrifuge 11 and defines a space 13 therefrom.

The housing 12 has a generally square shape having upstanding side walls 14 with upstanding corner walls therebetween. The centrifuge 11 has an annular wall 17. The centrifuge 11 is detailed to carry a conventional centrifugal rotor, not shown. The centrifuge 11 has a bottom 21. The centrifuge 11 may be detailed to have a conventional cover 22 which may easily overlie and close the centrifuge 11 or it may be hermetically sealed whereby a vacuum may be applied internally of the centrifuge 11, as desired.

The centrifuge 11 has in this configuration at least one thermoelectric module 16, if a plurality, spaced about externally of the centrifuge 11 with the cooling surface in heat conducting relationship with the outer surface of the centrifuge 11, thereby effectively cooling the internal space 13 of the centrifuge 11 and the centrifuge rotor (not shown) contained therein.

The centrifuge 11 has a 21, with a bore 25 centrally therethrough. A shaft from a vertically upstanding electric motor 23 extends above the bottom 21. A conventional rotor is keyed to the shaft of the rotor for rotation in a conventional manner. The centrifuge 11 is shown with a cross-sectional view of a thermoelectric module 16 which is in close association with the centrifuge 11, especially the wall thereof, to achieve good thermal conduction with one side of the thermoelectric module and the centrifuge surface. It is pointed out that the thermoelectric modules 16 are of conventional construction and commercially available.

As often a number of thermoelectric modules 16 are employed, the heated side thereof is at the part extending away from the centrifuge 11. As stated, in the above the housing 12 has a substantially square configuration, space is thereby provided for a heat sink 26 for dissipation of heat. The heated side of the thermoelectric modules 16 are each thermally connected to relatively large blocks 18 positioned tangentially with respect to the cylindrical centrifuge 11.

The blocks 18 has a plurality of spaced horizontal fins 27 having each end thereof in uniform heat conducting relationship with the hot side of each of the thermoelectric module 16 through said blocks 18.

A source of moderately high velocity air emanates from a motor driven blower 29 of conventional structure and configuration. A second exhaust blower 31, also of conventional structure and configuration is located at the opposite side of the housing 12.

As space is also present between the area defined by the centrifuge 11, the housing 12 and the thermoelectric modules 16 it is pointed out that such space is filled with insulating thermoplastic foam such as polyurethane which is foamed in situ.

What is claimed is:

1. A thermoelectrically cooled device for a centrifuge having a rotor comprising in combination;

a centrifuge housing having at least one side ingress port and at least one oppositely disposed side egress port;

said centrifuge housing having a top portion;

a thermal conductive chamber adapted and constructed to contain a rotor of said centrifuge;

said centrifuge housing surrounding said chamber and defining a space therebetween housing;

at least one thermoelectric module having a cooling side and a heating side;

said cooling side of said thermoelectrically module being attached to said chamber in said space;

at least one heat sink attached to a heating side of said thermoelectric module to form a unitary and locally rigid structure with said chamber at the point of attachment;

said at least one thermoelectrically cooling module having a first heat receiving side communicated to said side of said chamber and having a heat discharge side for passing heat energy away from said chamber;

said heat discharge side including a plurality of horizontally disposed fins positioned in said space between said chamber and said housing communicated to each of said thermoelectric modules at said heat discharge side for dissipation, heat energy from said chamber and heat energy from said thermoelectric module;

said side ingress port of said housing having air pressurizing means and means direction, the pressurized air horizontally between said fins and out the egress port of said housing to thereby remove heat.

2. The thermoelectrically cooled device according to claim 1 wherein the egress port of said housing has air exhausting means.

3. The thermoelectrically cooled device according to claim 1 wherein the ingress air pressurizing means in an electrically driven fan.

4. The thermoelectrically cooled device according to claim 2 wherein the egress air exhausting means is an electrically driven fan.

* * * * *